United States Patent [19]

Hyne

[11] Patent Number: 4,624,208

[45] Date of Patent: Nov. 25, 1986

[54] MAST SUPPORTING STRUCTURE

[76] Inventor: Douglas C. Hyne, 49 George Street, Marmong Point, NSW, Australia

[21] Appl. No.: 718,421

[22] Filed: Apr. 1, 1985

[30] Foreign Application Priority Data

Apr. 2, 1984 [AU] Australia ..... PG4372

[51] Int. Cl.[4] ..... B63B 7/08

[52] U.S. Cl. ..... 114/345; 114/93; 114/102; 441/40

[58] Field of Search ..... 114/39, 345, 102, 90, 114/93; 441/40

[56] References Cited

U.S. PATENT DOCUMENTS

| | | | |
|---|---|---|---|
| 3,839,979 | 10/1974 | Wassell | 114/39 X |
| 4,082,049 | 4/1978 | Nicol | 114/345 X |
| 4,149,481 | 4/1979 | Leber | 114/39 |
| 4,249,276 | 2/1981 | Snyderman | 114/102 X |
| 4,348,971 | 9/1982 | Montgomery | 114/39 X |

FOREIGN PATENT DOCUMENTS

| | | | |
|---|---|---|---|
| 944106 | 6/1956 | Fed. Rep. of Germany | 114/345 |
| 1186357 | 1/1965 | Fed. Rep. of Germany | 114/345 |

*Primary Examiner*—Sherman D. Basinger
*Assistant Examiner*—Paul E. Salmon
*Attorney, Agent, or Firm*—Michael J. Striker

[57] ABSTRACT

A mast supporting structure for an inflatable dinghy including a pair of stringers for connection to the floor of the dinghy, a mast receiving tube adapted to receive the lower end of a mast, a transverse support member resting on the floor of the dinghy and which supports the lower end of the mast receiving tube, and a plurality of struts. The transverse support member is connected to one of the stringers at each of its ends and each strut being connected at one end to the mast supporting tube and at the other end to one of the stringers. The mast supporting structure may be connected together in articulated fashion so that it may be collapsed into a neat package in which all the parts lie alongside one another for transport and storage. When erected the mast supporting structure is connected to the floor of an inflatable dinghy and provides a rigid support for a sail carrying mast.

8 Claims, 14 Drawing Figures

MAST SUPPORTING STRUCTURE

BACKGROUND OF THE INVENTION

1. Field of the Invention

The present invention relates to a mast supporting structure for use in an inflatable dinghy.

2. Description of the Prior Art

Inflatable dinghies are well known and widely used as recreational vehicles and as tenders for yachts. Such dinghies are conventionally propelled by oars or by an outboard motor. It is known to provide a sailing rig for inflatable dinghies, however, such rigs have not been satisfactory. It has been difficult to provide rigging which is sufficiently stiff to allow the dinghy to sail efficiently. It has also been conventional to provide stays between the mast and the dinghy which are connected, at one end, to the fabric of the dinghy; there has been a tendency for the points of attachment to represent a weakness in the structure. The points of attachment have either torn away from the fabric of the dinghy or have caused a tearing of the dinghy fabric itself. The present invention provides a novel mast support structure for use in an inflatable dinghy which may be made substantially free from the foregoing defects.

Typical prior art sailing rigs for inflatable craft are disclosed in the following U.S. Pat. Nos.:

4,082,049
4,249,276
4,149,481
4,249,276, and
3,682,123.

SUMMARY OF THE INVENTION

The present invention consists in a mast support structure for use in an inflatable dinghy, comprising a pair of stringers adapted for connection to a dinghy, a mast receiving tube adapted to receive the lower end of a mast, a transverse support member on which the mast receiving tube is adapted to rest and which member extends laterally from the lower end of the mast receiving tube and is adapted to be connected at each of its free ends to one of the stringers, and a plurality of struts extending between the mast receiving tube and the stringers, each connected at one end to the mast receiving tube at a point along its length distal to its lower end, at least one of the struts being connected at its other end to each of the stringers.

The present invention further consists in an inflatable dinghy fitted with a mast supporting structure according to this invention.

In a preferred form of the invention the stringers each comprise a length of wood or like material and each runs substantially the full length of the dinghy. Each stringer is fitted with means, or otherwise adapted, for connection to the floor, or another part, of a dinghy. In preferred embodiments of the invention the connection between the dinghy and the stringers is such that a degree of movement is possible between the dinghy and the stringer. This non-rigid connection is, in one embodiment of the invention, achieved by connecting one end of each stringer to the dinghy through a sliding connection which allows sliding movement between the stringer and the dinghy in the direction of the longitudinal axis of the stringer while connecting the other end of the stringer to the dinghy through a sliding connection which allows sliding movement between the stringer and the dinghy in a direction transverse to the longitudinal axis of the stringer.

The stringers may be connected to reinforcing pads formed on the fabric of the dinghy itself or they may be connected to floorboards provided in the dinghy. Most preferably the stringers are so placed that they lie along the floor of the dinghy one on each side thereof hard up against the side chambers of the hull of the inflatable dinghy.

A mast receiving tube is included in the mast supporting structure. The mast receiving tube is adapted to receive the lower end of a mast either internally or externally and is sufficiently long to adequately support the mast. The mast receiving tube will, when the mast supporting structure is assembled in a dinghy, extend substantially vertically. The mast receiving tube is most conveniently formed of aluminium, though tubes of other materials may also be used. It will be appreciated that if the mast is received externally of the mast receiving tube the tube may be substituted by a rod or like member which is hereby included within the term "mast receiving tube".

The mast receiving tube rests at its lower end on a transverse support member. The transverse support member extends between the two stringers and, is adapted to be connected to each of them. The transverse support member may comprise a unitary piece of wood, aluminium or the like. It is, however, preferred that the transverse support member is made in a plurality of parts connected together in an articulatable manner. Most preferably the transverse support member includes a central section connected to the lower end of the mast receiving tube and a pair of laterally extending sections pivotably attached to the central section and each provided at its free end with means for connecting the transverse support member to the stringers. Most preferably the connecting means comprise a pin extending longitudinally from the free end of each of the laterally extending sections of the transverse support member which pins are adapted for insertion into corresponding bores in the side of the respective stringers.

The mast supporting structure further includes a number of struts each extending between an upper end of the mast receiving tube and the stringers and/or the transverse support member. In a preferred embodiment of the invention the mast supporting structure includes four struts. In this arrangement the four struts are pivotably connected at their upper ends to a slide adapted to slide along the mast receiving tube. Two of the struts are pivotably connected adjacent the outer ends of the lateral sections of the transverse support member while the other two are each adapted for connection to a respective one of the stringers intermediate the ends of that stringer. This arrangement allows the assembly comprising the struts, the transverse support member and the mast receiving tube to be connected together such that the assembly may be collapsed into a neat package in which all the parts lie alongside one another for transport and storage while also allowing the assembly to be expanded until the transverse support member extends substantially at right angles to the mast receiving tube and the assembly can be connected to the stringers.

In a preferred embodiment of the invention an additional pair of struts is provided between the central section of the transverse support member and the stringers. Desirably these additional struts are connected to the stringers at the same point as the struts extending between the slide on the mast receiving tube and the stringers. These struts and the additional struts are preferably connected to the stringers by pins extending through holes adjacent the ends of the struts into corresponding bores formed in the sides of the respective stringers. The pins preferably extend from the ends of a toggle bar to which they are pivotably connected. The toggle bar comprises a pair of elongate members pivotably connected together at their mid point. When the toggle bar is placed between the stringers with its two elongate members at an angle to one another and the pins extending through the holes in the ends of the struts, the pins will be forced into the bores in the stringers as the toggle bar is straightened and its elongate members brought into alignment.

The mast supporting structure according to this invention is preferably used in conjunction with a leeboard strut which is releasably connected to the mast receiving tube and/or one or more of the struts. The leeboard strut extends transversely of the longitudinal axis of the dinghy and rests on the side chamber thereof. A leeboard rail preferably extends rearwardly from each end of the leeboard strut just above and parallel to one of the side chambers of the dinghy. The rearward end of each of the leeboard rails is connected to the adjacent side chamber preferably through a rowlock moulded integrally with the side chamber of the dinghy. Each leeboard rail preferably has a leeboard connected to it in such a way that the position of the leeboard may be adjusted by sliding the leeboard fore or aft along its associated leeboard rail.

The mast supporting structure most preferably supports an unstayed mast which carries a single sail. The sail may be of the Bermudan type, the gaff type, the lug sail type or the fully battened junk type. If desired however a foresail may be rigged though this will require the rigging of at least a forestay. If such a forestay is to be rigged then it is preferable to provide a forestay strut extending from the mast receiving tube forwardly, in a substantially horizontal plane, to the base of the dinghy at a height just below the upper edge of the inflated chambers of the dinghy. The forward end of the forestay strut is preferably connected to the head of the mast by a forestay and to the foot of the mast receiving tube by a bobstay.

If desired the stringers may be formed integrally with the floor of the dinghy or indeed a rigid floor on the dinghy may itself constitute the stringers. The struts of the mast supporting structure are preferably formed such that their length may be altered by a telescopic adjustment between individual strut parts. This arrangement allows a single mast supporting structure to be used with a variety of differently sized dinghies.

Hereinafter given by way of example only is a preferred embodiment of the present invention described with reference to the accompanying drawings in which:

FIG. 1 is perspective view of a mast supporting structure according to the present invention erected in a dinghy and with leeboards, a tiller and a forestay strut in position;

FIGS. 2*a* and 2*b* are respectively a front and a rear elevational view of a part of the mast supporting structure of FIG. 1;

Figure 1:
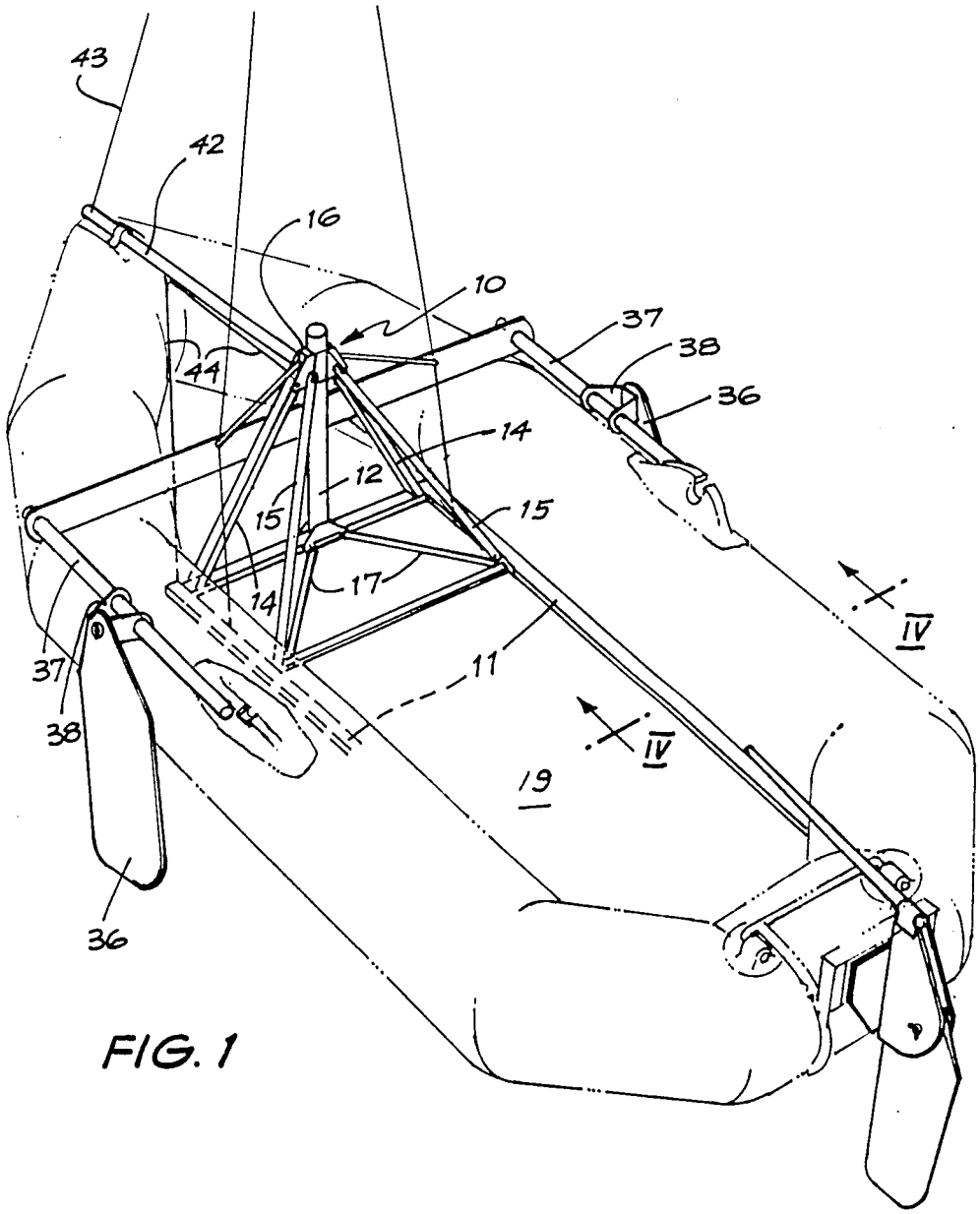
Figure 2A:
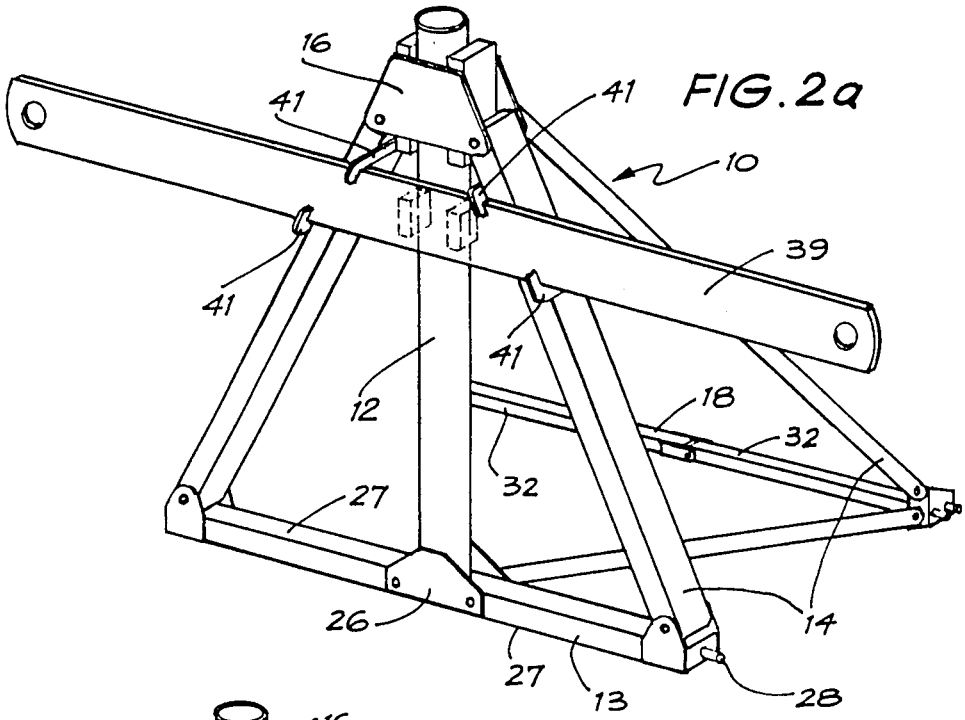
Figure 2B:
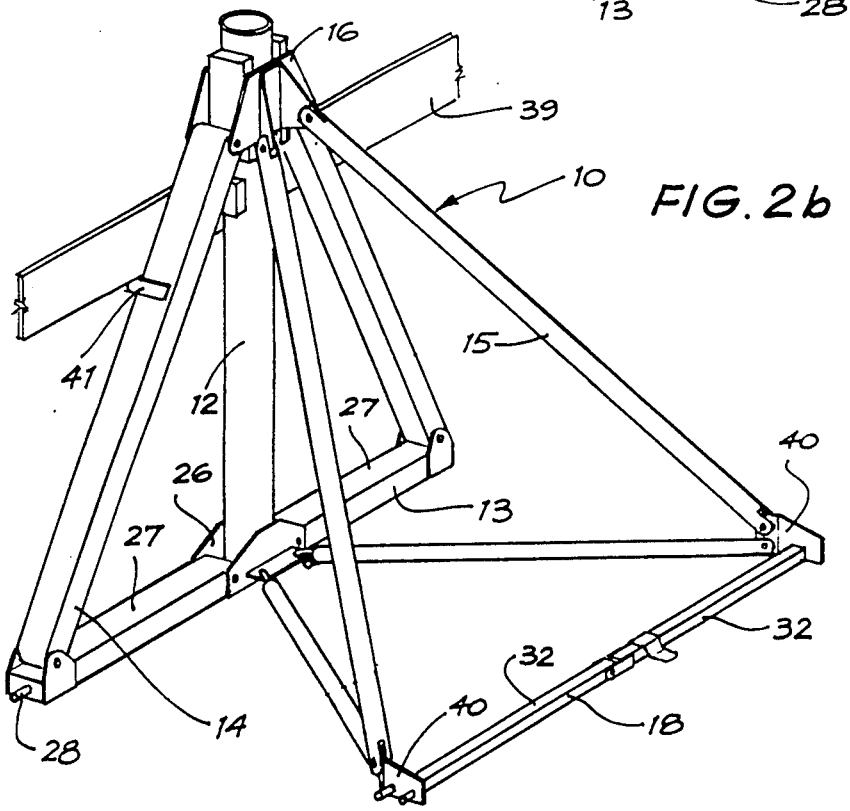
Figure 3:
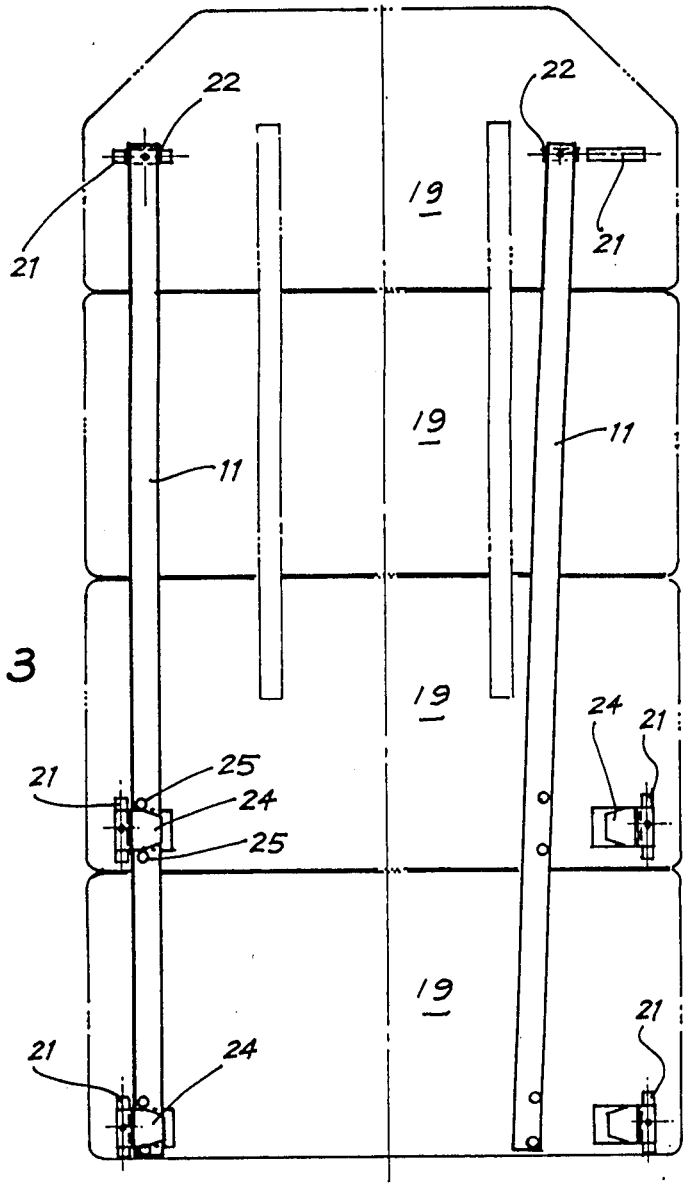
FIG. 3 is a plan view of the floor of a dinghy showing the stringers of the mast supporting structure of FIG. 1 and the means for their connection to the floor.
Figure 4:
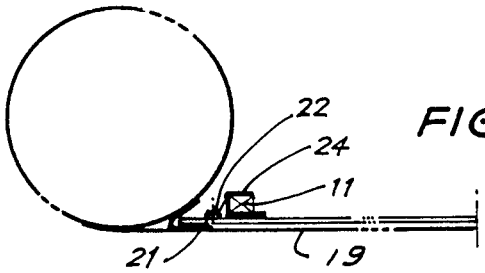
FIG. 4 is a cross sectional view along IV—IV of FIG. 1.
Figure 5:
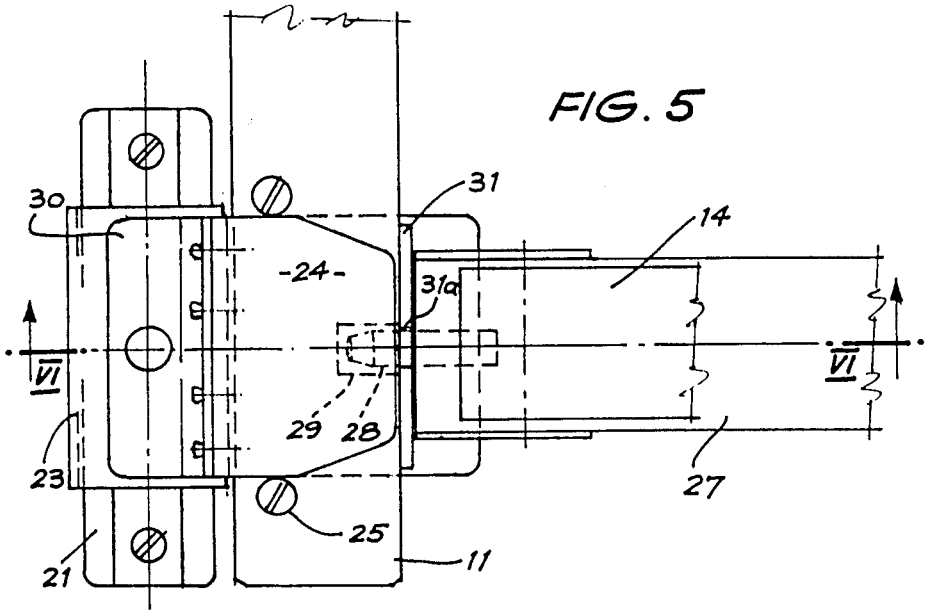
FIG. 5 is a detailed plan view of the connection of the forward end of a stringer of the mast supporting structure of FIG. 1 to the transverse support member thereof and to the floor of a dinghy.
Figure 6:
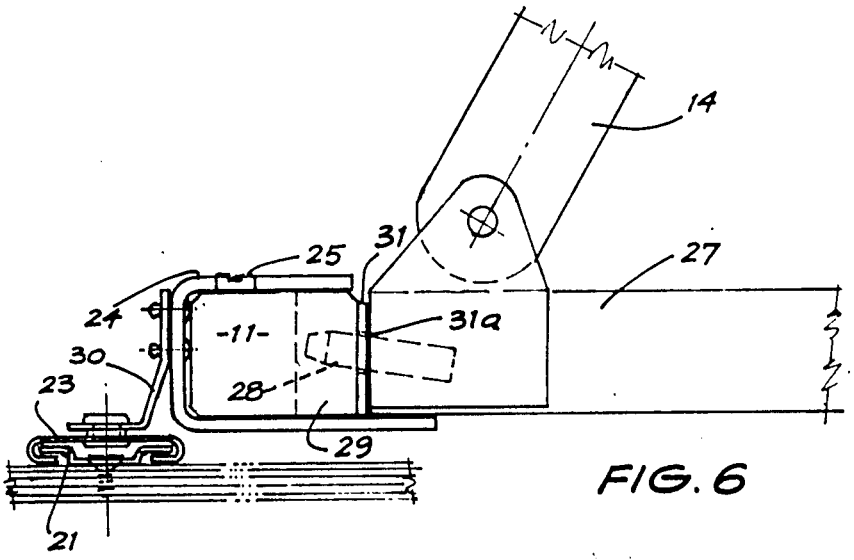
FIG. 6 is a vertical sectional view along VI—VI of FIG. 5.
Figure 7:
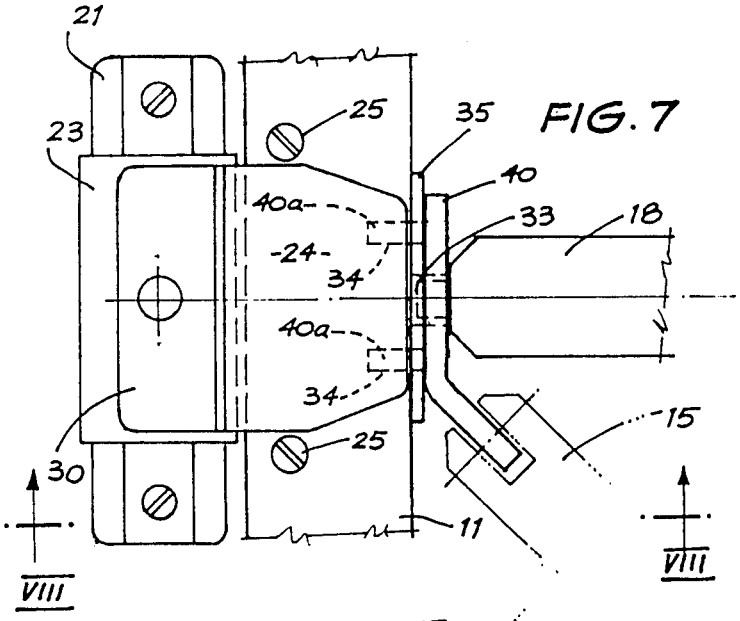
FIG. 7 is a detailed plan view of the connection of an intermediate portion of a stringer of the mast supporting structure of FIG. 1 to a strut and a toggle bar thereof and to the floor of a dinghy.
Figure 8:
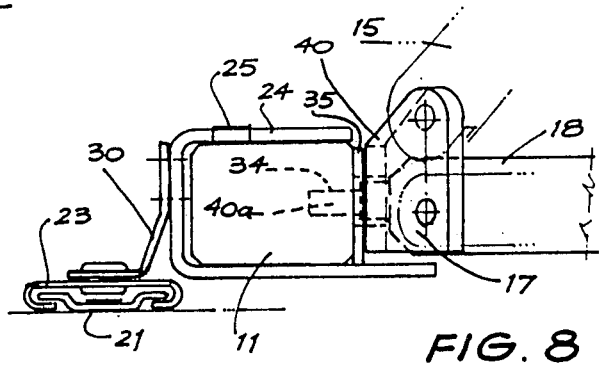
FIG. 8 is a vertical sectional view along VIII—VIII of FIG. 7.
Figure 9A:
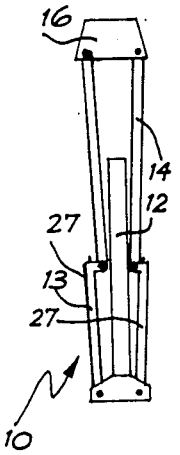
Figure 9B:
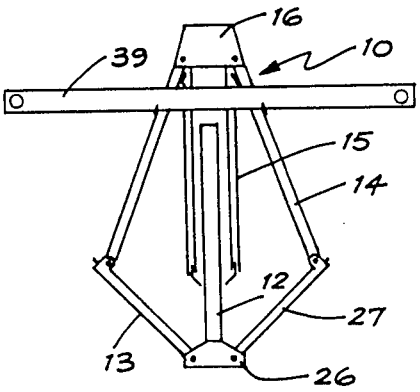
Figure 9C:
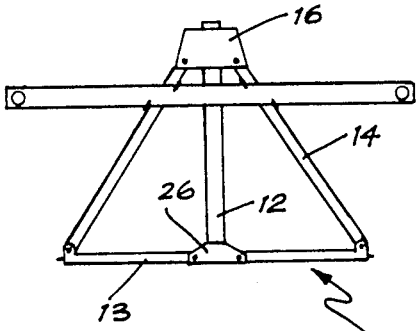
Figure 9D:
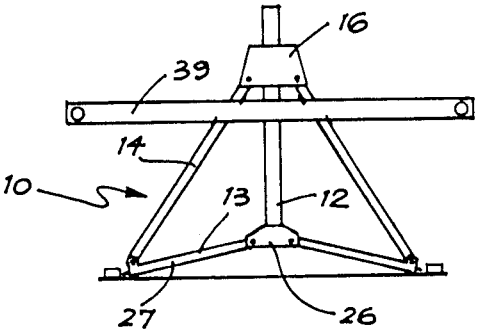
Figure 9E:
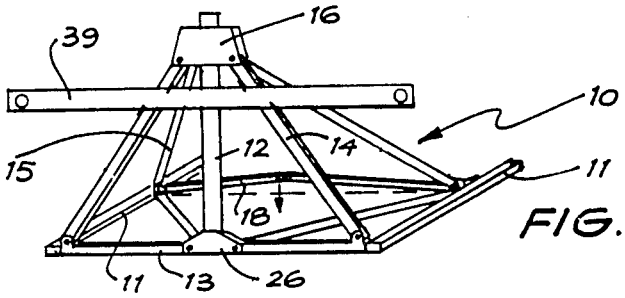

FIGS. 9*a* to *e* show diagrammatically the steps in assembling the mast supporting structure of FIG. 1.

As is seen most clearly in FIG. 1 the mast supporting structure 10 comprises a pair of stringers 11, a mast receiving tube 12, a transverse support member 13 extending between the stringers 11 and supporting the lower end of the tube 12, and two pairs of struts 14 and 15. The struts 14 connect a slide 16 on the mast supporting tube with the free ends of the support member 13 and the struts 15 connect the slide 16 with the stringers 11. An additional pair of struts 17 connect the base of the mast supporting tube 12 with the stringers 11 and a toggle bar 18 extends between the free ends of the struts 17 and connects each of them to its associated stringer 11.

Each of the stringers 11 comprises an elongate length of wood of square cross section. The floor 19 of the dinghy is fitted with three pairs of short sections of slide track 21. The forward two pairs of tracks 21 are aligned fore and aft while the aft pair of tracks are aligned transversely of the dinghy. Each stringer 11 is provided at its aft end with slide 22 which is pivotably connected to the stringer 11 and is adapted to slide along one of the aft tracks 21. A slide 23 is positioned on each of the two forward pairs of slide tracks 21. Each slide 23 is connected through an L-shaped spring 30 on its upper surface to a side opening C-shaped spring clip 24. Each stringer 11 is formed in its upper surface with a pair of upstanding bosses 25 adapted to lie on either side of the clip 24.

In assembling the stringers 11 in the dinghy the slide 22 is slid onto one of the aft slide tracks 21, the slides 23 are positioned on each of the forward slide tracks 21 in alignment with the aft slide track 21 used, and the stringer 11 is rotated about its pivotal connection with the slide 22 until the stringer 11 is nested with the two C-shaped clips 24 on the slides 23 with the bosses 25 lying on either side of the clips 24. The stringer will thus be connected to the floor of the dinghy while still allowing a degree of independent movement between the stringers and the floor.

The transverse support member 13 includes a central U-shaped section 26 riveted to the lower end of the mast receiving tube 12. The central section is independently pivotably connected to each of two lateral sections 27. Each of the lateral sections 27 includes a pin 28 extending from its free end. Each pin 28 extends axially of its associated lateral section 27 when seen in plan view but when seen in side elevational view it is inclined upwardly. When the mast supporting structure 10 is assembled the pins 28 are adapted to project into corresponding slots 29 in the sides of stringers 11. In order to strengthen the stringers 11 in the region of the slots 29 a metal plate 31 is affixed to the side of the stringer 11 into which the slots 29 opens. A hole 31*a* is provided in the plate 31 to receive snugly the pin 28.

The slide 16 comprises a pair of aluminium plates screwed to wooden spacers on either side of the mast receiving tube 12. The slide 16 is free to move along the mast receiving tube without obstruction. The struts 14 are each pivotably connected at one end to the slide 16 and at the other end to the free end of one of the lateral sections of the transverse support members 13. The struts 15 are also each pivotably connected at their upper end to the slide 16. At their other ends each of the struts 15 are pivotably connected with a respective one of two plates 40. The struts 17 are removably and pivotably connected to the central section 26 of the transverse support members 13 and are also pivotably connected at their free ends with a respective one of the plates 40.

The toggle bar 18 is formed of two sections 32 which are pivotably connected together. At their free ends the sections 32 each bear an axially extending pin 33. The pins 33 each extend, when the mast supporting structure is assembled, respectively through holes in the plates 40. Each plate 40 carries a pair of pins **40*a* which extend into bores 34 in the side of a respective one of the stringers 11. The integrity of the bores 34 are protected by a plate 35. The pins 40*a* are positioned in bores 34 and the pins 33 are positioned in the holes in plate 40 by extending the pins into the holes in the plates 40 with the toggle bar 18 bent about the pivot between the sections 32 and by then straightening the toggle bar 18 the pins are moved laterally outwardly into the respective holes in the plates 40 and hold the pins 40*a* on plates 40 in the bores 34**.

Pin means (not shown) are provided to extend through corresponding holes in the slide 16 and the mast receiving tube (and the mast when it is in position) to lock the mast supporting structure 10 into its assembled configuration. This pin means also prevents loss of the mast in the event that the dinghy should capsize and become totally inverted.

As is best seen in FIG. 9 the mast supporting structure 10 may be disassembled by releasing the toggle bar 18 which frees the struts 15 and 17 from their connection with one of the stringers 11. The mast receiving tube 12 can then be lifted upwardly relative to slide 16 causing the lateral sections 27 of the support member 13 to pivot downwardly relative to the slide 16 drawing the free ends of the transverse member inwardly and releasing the pins 28 from the bores 29 in stringers 11. The slide 16 may then be slid up the mast receiving tube 12 to collapse the struts 14, 15 and 17 and the lateral section 27 of the transverse support member against the mast receiving tube for storage. The stringers 11 may be removed from the dinghy by reversing the assembly procedure described above.

The dinghy is preferably also fitted with a pair of leeboards 36. The leeboards 36 are each supported on a longitudinally extending leeboard rail 37 through a bracket 38 which may pivot about the rail 37 and may be slid along the rail 37 against frictional resistance. At their aft ends the rails 37 are each fixed to a moulded rowlock on the dinghy. At their forward ends the rails 37 each project loosely through holes in a leeboard strut 39. The leeboard strut 39 extends transversely of the fore-aft axis of the dinghy and clips onto the mast receiving tube 12 and the struts 14.

Brackets 41 on the struts 14 engage about the leeboard strut 39 as the mast supporting structure 10 is erected thereby locking the leeboard strut 39 in position.

If desired a mainsheet track (not shown) may be provided between the aft ends of the stringers 11. Similarly if desired a forestay strut 42 may be provided to extend forwardly from the leeboard strut to the bow of the dinghy. The forestay strut 42 is held in place by the forestay 43 and a bobstay 44.

It will be appreciated that numerous modifications or alterations could be made to the mast supporting structure described without departing from the essential features of the invention as hereinbefore defined. For instance, a "dry" floor may be provided on top of the stringers which would serve in place of the toggle bar and the struts connecting the foot of the mast receiving tube with the stringers. If the rig were set up with a forestay and shrouds then a smaller number of struts linking the mast supporting tube with the stringers would be required. It will also be appreciated that the slide tracks for connection of the stringers to the dinghy may be provided on a wooden floor of the dinghy or on reinforcing pads moulded onto the dinghy.

It should also be noted that many alternative constructions could be used for the pivotable connection between the slide, the struts, the support member and the stringers.

If the dinghy is fitted with a transom it may be desirable to extend the stringers aft sufficiently to be connectable to the transom. It will be also appreciated that the dinghy will require to be fitted with running rigging and a tiller all of which will be of conventional design suitable for use with the sail plan selected.

I claim:

1. A mast support structure for use in an inflatable dinghy which comprises at least two lateral hull sections and an intermediate floor, the structure comprising a pair of substantially longitudinally extending stringer members adapted for connection to the floor of the dinghy;

a mast receiving tube adapted to receive the lower end of a mast carrying a sail;

a substantially transversely extending support member on which the mast receiving tube is adapted to be connected and comprising a central part which is connectable to the lower end of the mast receiving tube and is pivotably connected to a pair of lateral parts of the support member each of which lateral parts is adapted to be releasably connected at its free end to a respective one of the stringer members;

a first pair of struts disposed substantially coplanar with the support member, each of which struts is pivotably connected at one end to the mast receiving tube at a point distal to the support member and connectable at its other end to a respective one of the stringer members;

a second pair of struts each of which is pivotably connected at one end to the mast receiving tube at a point distal to the support member and is adapted to be releasably connected at its other end to a respective one of the stringer members at a position distal to that stringer members position of attachment to the support member; and a third pair of struts each of which is connectable at one end to the central part of the support member and its other end to a respective one of the stringer members distal to that stringer member's position of attachment to the support member.

2. A mast supporting structure as claimed in claim 1 in which each of the first and second pair of struts is pivotably connected to a slide disposed slidably on the mast receiving tube.

3. A mast supporting structure as claimed in claim 1 in which the other end of each of the first pair of struts is pivotably connected to the free end of a respective one of the lateral parts of the support member and is thus indirectly connected to the respective stringer member.

4. A mast supporting structure as claimed in claim 1 in which the other ends of each of the second pair of struts are pivotably connected to a bracket which is in turn connected to a respective one of the stringer members, the other end of one of the third pair of struts also being pivotably connected to each bracket.

5. A mast supporting structure as claimed in claim 1 in which a leeboard strut is releasably connected to, and extends laterally of, the mast receiving tube and at least one of the struts, a leeboard rail extending rearwardly of each end of the leeboard strut and each rail being adapted to be connected at its free end to an inflatable dinghy on which the mast supporting structure is mounted.

6. An inflatable dinghy fitted with a mast supporting structure as claimed in claim 1.

7. A mast supporting structure as claimed in claim 1 in which each stringer member is connected to the floor of the dinghy such that a degree of movement is possible between the dinghy and the stringer member.

8. A mast supporting structure as claimed in claim 1 in which each stringer member is connected at one end to the dinghy through a sliding connector which allows sliding movement between the stringer member and the dinghy in the direction of the longitudinal axis of the stringer member and in which the other end of each stringer member is connected to the dinghy through a sliding connection which allows sliding movement between the stringer member and the dinghy in a direction transverse to the longitudinal axis of the stringer member.

* * * * *